US010232332B2

(12) United States Patent
Oehring et al.

(10) Patent No.: US 10,232,332 B2
(45) Date of Patent: Mar. 19, 2019

(54) INDEPENDENT CONTROL OF AUGER AND HOPPER ASSEMBLY IN ELECTRIC BLENDER SYSTEM

(71) Applicant: US WELL SERVICES LLC, Houston, TX (US)

(72) Inventors: Jared Oehring, Houston, TX (US); Brandon N. Hinderliter, Houston, TX (US)

(73) Assignee: U.S. Well Services, Inc., Houston, TX (US)

( * ) Notice: Subject to any disclaimer, the term of this patent is extended or adjusted under 35 U.S.C. 154(b) by 0 days.

(21) Appl. No.: 15/294,349

(22) Filed: Oct. 14, 2016

(65) Prior Publication Data

US 2017/0028368 A1 Feb. 2, 2017

Related U.S. Application Data

(63) Continuation-in-part of application No. 15/202,085, filed on Jul. 5, 2016, which is a continuation of (Continued)

(51) Int. Cl.
*B28C 7/04* (2006.01)
*B28C 7/10* (2006.01)
(Continued)

(52) U.S. Cl.
CPC .... *B01F 15/0235* (2013.01); *B01F 15/00519* (2013.01); *B01F 15/00538* (2013.01); (Continued)

(58) Field of Classification Search
CPC .. E04G 21/04; B28C 7/00; B28C 7/02; B28C 5/0875; B28C 9/04; B28C 7/0454; (Continued)

(56) References Cited

U.S. PATENT DOCUMENTS 1,671,436 A 5/1928 Melott
2,004,077 A 6/1935 McCartney
(Continued)

FOREIGN PATENT DOCUMENTS

CA 2966672 10/2012
CN 101977016 2/2011
(Continued)

OTHER PUBLICATIONS

UK Power Networks—Transformers to Supply Heat to Tate Modern—from Press Releases May 16, 2013.
(Continued)

*Primary Examiner* — Charles Cooley
(74) *Attorney, Agent, or Firm* — Hogan Lovells US LLP

(57) ABSTRACT

Embodiments relate to a hydraulic fracturing system that includes a blender unit. The system includes an auger and hopper assembly to receive proppant from a proppant source and feed the proppant to the blender unit for mixing with a fluid. A first power source is used to power the blender unit in order to mix the proppant with the fluid and prepare a fracturing slurry. A second power source independently powers the auger and hopper assembly in order to align the hopper of the auger and hopper assembly with a proppant feed from the proppant source. Thus, the auger and hopper assembly can be stowed or deployed without use of the first power source, which is the main power supply to the blender unit.

7 Claims, 7 Drawing Sheets

Related U.S. Application Data application No. 13/679,689, filed on Nov. 16, 2012, now Pat. No. 9,410,410.

(60) Provisional application No. 62/242,657, filed on Oct. 16, 2015.

(51) Int. Cl.

| | |
|---|---|
| ***B28C 9/04*** | (2006.01) |
| ***B01F 15/00*** | (2006.01) |
| ***B01F 15/02*** | (2006.01) |
| ***E21B 43/26*** | (2006.01) |
| ***F04B 17/03*** | (2006.01) |
| ***F04B 17/06*** | (2006.01) |
| ***F04B 19/22*** | (2006.01) |
| ***F04B 23/00*** | (2006.01) |
| ***F04B 47/02*** | (2006.01) |
| ***F04B 49/06*** | (2006.01) |
| ***F04B 49/20*** | (2006.01) |
| ***E21B 43/267*** | (2006.01) |

(52) U.S. Cl.

CPC ..... *B28C 7/0477* (2013.01); *B28C 7/10* (2013.01); *B28C 9/04* (2013.01); *E21B 43/26* (2013.01); *E21B 43/267* (2013.01); *F04B 17/03* (2013.01); *F04B 17/06* (2013.01); *F04B 19/22* (2013.01); *F04B 23/00* (2013.01); *F04B 47/02* (2013.01); *F04B 49/065* (2013.01); *F04B 49/20* (2013.01); *B01F 2215/0081* (2013.01)

(58) Field of Classification Search

CPC ..... B28C 7/044; B28C 9/0454; B28C 7/0418; B28C 7/0422; B28C 7/0477; B28C 7/10; B01F 15/0235; B01F 15/00538; B01F 15/00519; B01F 2215/0081; F01D 15/08; F01D 15/10; F02C 3/22; F04B 49/20; F04B 19/22; F04B 17/03; H02P 23/00; E21B 43/26; E21B 43/267

USPC .... 366/14–20, 27–29, 64–66, 37–38, 31–32, 366/33–35, 50–51, 41

See application file for complete search history.

(56) References Cited

U.S. PATENT DOCUMENTS 2,183,364 A 12/1939 Bailey
2,220,622 A 11/1940 Aitken
2,248,051 A 7/1941 Armstrong
2,753,940 A 7/1956 Bonner
3,061,039 A 10/1962 Peters
3,066,503 A 12/1962 Fleming
3,334,495 A 8/1967 Jensen
3,722,595 A 3/1973 Kiel
3,764,233 A 10/1973 Strickland
3,773,140 A 11/1973 Mahajan
3,837,179 A 9/1974 Barth
3,849,662 A 11/1974 Blaskowski
3,881,551 A 5/1975 Terry
4,037,431 A 7/1977 Sugimoto
4,151,575 A 4/1979 Hogue
4,226,299 A 10/1980 Hansen
4,265,266 A 5/1981 Kierbow et al.
4,432,064 A 2/1984 Barker
4,442,665 A 4/1984 Fick et al.
4,456,092 A 6/1984 Kubozuka
4,506,982 A * 3/1985 Smithers ..... B01F 7/00641 366/142
4,512,387 A 4/1985 Rodriguez
4,529,887 A 7/1985 Johnson
4,538,916 A * 9/1985 Zimmerman ..... B28C 9/0463 366/186
4,676,063 A 6/1987 Goebel et al.
4,793,386 A 12/1988 Sloan
4,845,981 A 7/1989 Pearson
4,922,463 A * 5/1990 Del Zotto ..... B28C 9/0463 222/189.06
5,006,044 A 4/1991 Walker, Sr.
5,025,861 A 6/1991 Huber et al.
5,130,628 A 7/1992 Owen
5,131,472 A 7/1992 Dees et al.
5,422,550 A 6/1995 McClanahan
5,548,093 A 8/1996 Sato
5,590,976 A * 1/1997 Kilheffer ..... E01C 19/46 177/119
5,655,361 A 8/1997 Kishi
5,736,838 A 4/1998 Dove et al.
5,790,972 A 8/1998 Kohlenberger
5,865,247 A 2/1999 Paterson
5,879,137 A 3/1999 Yie
5,894,888 A 4/1999 Wiemers
5,907,970 A 6/1999 Havlovick et al.
6,138,764 A 10/2000 Scarsdale et al.
6,142,878 A 11/2000 Barin
6,164,910 A 12/2000 Mayleben
6,202,702 B1 3/2001 Ohira
6,254,462 B1 7/2001 Kelton
6,271,637 B1 8/2001 Kushion
6,315,523 B1 11/2001 Mills
6,477,852 B2 11/2002 Dodo
6,491,098 B1 12/2002 Dallas
6,529,135 B1 3/2003 Bowers et al.
6,776,227 B2 8/2004 Beida
6,802,690 B2 10/2004 Han
6,808,303 B2 * 10/2004 Fisher ..... B28C 5/1246 366/26
6,931,310 B2 8/2005 Shimizu et al.
7,104,233 B2 9/2006 Ryczek et al.
7,170,262 B2 1/2007 Pettigrew
7,173,399 B2 2/2007 Sihler
7,312,593 B1 12/2007 Streicher et al.
7,336,514 B2 2/2008 Amarillas
7,445,041 B2 11/2008 O'Brien
7,494,263 B2 2/2009 Dykstra et al.
7,500,642 B2 3/2009 Cunningham
7,525,264 B2 4/2009 Dodge
7,563,076 B2 7/2009 Brunet
7,675,189 B2 3/2010 Grenier
7,683,499 B2 3/2010 Saucier
7,717,193 B2 5/2010 Egilsson et al.
7,755,310 B2 7/2010 West et al.
7,807,048 B2 10/2010 Collette
7,845,413 B2 12/2010 Shampine
7,977,824 B2 7/2011 Halen et al.
8,037,936 B2 10/2011 Neuroth et al.
8,054,084 B2 11/2011 Schulz et al.
8,083,504 B2 12/2011 Williams
8,096,891 B2 1/2012 Lochtefeld
8,139,383 B2 3/2012 Efraimsson et al.
8,146,665 B2 4/2012 Neal
8,154,419 B2 4/2012 Daussin et al.
8,232,892 B2 7/2012 Overholt et al.
8,261,528 B2 9/2012 Chillar
8,272,439 B2 9/2012 Strickland
8,310,272 B2 11/2012 Quarto
8,354,817 B2 1/2013 Yeh et al.
8,474,521 B2 7/2013 Kajaria
8,534,235 B2 9/2013 Chandler
8,573,303 B2 11/2013 Kerfoot
8,596,056 B2 12/2013 Woodmansee
8,616,274 B2 12/2013 Belcher et al.
8,692,408 B2 4/2014 Zhang et al.
8,727,068 B2 5/2014 Bruin
8,760,657 B2 6/2014 Pope
8,774,972 B2 7/2014 Rusnak et al.
8,789,601 B2 7/2014 Broussard
8,807,960 B2 8/2014 Stephenson
8,838,341 B2 9/2014 Kumano
8,857,506 B2 10/2014 Stone, Jr.

(56) References Cited

U.S. PATENT DOCUMENTS 8,899,940 B2 12/2014 Laugemors
8,905,056 B2 12/2014 Kendrick
8,905,138 B2 12/2014 Lundstedt et al.
8,997,904 B2 4/2015 Cryer
9,018,881 B2 4/2015 Mao et al.
9,051,822 B2 6/2015 Ayan
9,067,182 B2 6/2015 Nichols
9,103,193 B2 8/2015 Coli
9,121,257 B2 9/2015 Coli et al.
9,140,110 B2 9/2015 Coli et al.
9,160,168 B2 10/2015 Chapel
9,322,239 B2 4/2016 Angeles Boza et al.
9,366,114 B2 6/2016 Coli et al.
9,410,410 B2 8/2016 Broussard et al.
9,450,385 B2 9/2016 Kristensen
9,475,020 B2 10/2016 Coli et al.
9,475,021 B2 10/2016 Coli et al.
9,534,473 B2 1/2017 Morris et al.
9,562,420 B2 2/2017 Morris et al.
9,587,649 B2 * 3/2017 Oehring ..... F04D 29/5806
9,611,728 B2 4/2017 Oehring
9,650,879 B2 5/2017 Broussard et al.
9,738,461 B2 * 8/2017 DeGaray ..... B65G 53/40
9,745,840 B2 8/2017 Oehring et al.
9,863,228 B2 1/2018 Shampine et al.
2002/0169523 A1 11/2002 Ross
2003/0138327 A1 7/2003 Jones et al.
2004/0040746 A1 3/2004 Niedermayr
2004/0102109 A1 5/2004 Cratty
2005/0116541 A1 6/2005 Seiver
2006/0052903 A1 3/2006 Bassett
2007/0187163 A1 8/2007 Cone
2007/0201305 A1 8/2007 Heilman et al.
2007/0226089 A1 * 9/2007 DeGaray ..... B28C 7/02 705/28
2007/0278140 A1 12/2007 Mallet et al.
2008/0112802 A1 5/2008 Orlando
2008/0137266 A1 6/2008 Jensen
2008/0208478 A1 8/2008 Ella et al.
2008/0217024 A1 9/2008 Moore
2008/0264649 A1 10/2008 Crawford
2009/0065299 A1 3/2009 Vito
2009/0078410 A1 3/2009 Krenek et al.
2009/0093317 A1 4/2009 Kajiwara et al.
2009/0095482 A1 4/2009 Surjaatmadja
2009/0153354 A1 6/2009 Daussin et al.
2009/0188181 A1 7/2009 Forbis
2009/0200035 A1 8/2009 Bjerkreim et al.
2009/0260826 A1 10/2009 Sherwood
2009/0308602 A1 12/2009 Bruins et al.
2010/0000508 A1 1/2010 Chandler
2010/0019574 A1 1/2010 Baldassarre
2010/0051272 A1 3/2010 Loree et al.
2010/0132949 A1 6/2010 DeFosse et al.
2010/0146981 A1 6/2010 Motakef
2010/0172202 A1 7/2010 Borgstadt
2010/0250139 A1 9/2010 Hobbs et al.
2010/0293973 A1 11/2010 Erickson
2010/0303655 A1 12/2010 Scekic
2010/0322802 A1 12/2010 Kugelev
2011/0005757 A1 1/2011 Hebert
2011/0017468 A1 1/2011 Birch et al.
2011/0061855 A1 3/2011 Case et al.
2011/0085924 A1 4/2011 Shampine
2011/0247878 A1 10/2011 Rasheed
2011/0272158 A1 11/2011 Neal
2012/0018016 A1 1/2012 Gibson
2012/0085541 A1 4/2012 Love et al.
2012/0127635 A1 5/2012 Grindeland
2012/0205301 A1 8/2012 McGuire et al.
2012/0205400 A1 * 8/2012 DeGaray ..... B28C 5/0875 222/192
2012/0232728 A1 9/2012 Karimi
2012/0255734 A1 10/2012 Coli et al.
2013/0009469 A1 1/2013 Gillett
2013/0025706 A1 * 1/2013 DeGaray ..... B28C 7/0418 137/351
2013/0175038 A1 7/2013 Conrad
2013/0175039 A1 7/2013 Guidry
2013/0199617 A1 * 8/2013 DeGaray ..... B65G 53/40 137/1
2013/0233542 A1 9/2013 Shampine
2013/0306322 A1 11/2013 Sanborn et al.
2013/0341029 A1 12/2013 Roberts et al.
2013/0343858 A1 12/2013 Flusche
2014/0000899 A1 1/2014 Nevison
2014/0010671 A1 1/2014 Cryer et al.
2014/0054965 A1 2/2014 Jain
2014/0095114 A1 4/2014 Thomeer
2014/0096974 A1 4/2014 Coli
2014/0124162 A1 5/2014 Leavitt
2014/0138079 A1 5/2014 Broussard et al.
2014/0174717 A1 6/2014 Broussard et al.
2014/0246211 A1 9/2014 Guidry
2014/0251623 A1 9/2014 Lestz et al.
2014/0379300 A1 12/2014 Devine et al.
2015/0068724 A1 3/2015 Coli et al.
2015/0068754 A1 3/2015 Coli et al.
2015/0075778 A1 3/2015 Walters
2015/0083426 A1 3/2015 Lesko
2015/0114652 A1 4/2015 Lestz
2015/0144336 A1 5/2015 Hardin et al.
2015/0159911 A1 6/2015 Holt
2015/0175013 A1 6/2015 Cryer et al.
2015/0176386 A1 6/2015 Castillo et al.
2015/0211524 A1 7/2015 Broussard
2015/0217672 A1 8/2015 Shampine
2015/0225113 A1 8/2015 Lungu
2015/0252661 A1 9/2015 Glass
2015/0300145 A1 10/2015 Coli et al.
2015/0314225 A1 11/2015 Coli et al.
2016/0032703 A1 * 2/2016 Broussard ..... E21B 43/267 166/250.01
2016/0105022 A1 4/2016 Oehring
2016/0160889 A1 6/2016 Hoffman et al.
2016/0177675 A1 6/2016 Morris et al.
2016/0177678 A1 6/2016 Morris
2016/0186531 A1 6/2016 Harkless et al.
2016/0208592 A1 * 7/2016 Oehring ..... H02K 9/04
2016/0208593 A1 7/2016 Coli et al.
2016/0208594 A1 7/2016 Coli et al.
2016/0208595 A1 7/2016 Tang
2016/0221220 A1 * 8/2016 Paige ..... B28C 9/0463
2016/0230524 A1 8/2016 Dumoit
2016/0230525 A1 8/2016 Lestz et al.
2016/0258267 A1 9/2016 Payne et al.
2016/0273328 A1 * 9/2016 Oehring ..... E21B 43/26
2016/0290114 A1 * 10/2016 Oehring ..... E21B 43/26
2016/0312108 A1 10/2016 Lestz et al.
2016/0319650 A1 * 11/2016 Oehring ..... E21B 43/267
2016/0326854 A1 11/2016 Broussard
2016/0326855 A1 11/2016 Coli et al.
2016/0348479 A1 12/2016 Oehring
2016/0349728 A1 12/2016 Oehring
2016/0369609 A1 12/2016 Morris et al.
2017/0021318 A1 1/2017 McIver et al.
2017/0022788 A1 * 1/2017 Oehring ..... E21B 41/0021
2017/0022807 A1 1/2017 Dursun
2017/0028368 A1 * 2/2017 Oehring ..... B01F 15/0235
2017/0030177 A1 * 2/2017 Oehring ..... E21B 43/26
2017/0030178 A1 * 2/2017 Oehring ..... E21B 43/26
2017/0036178 A1 2/2017 Coli et al.
2017/0037717 A1 2/2017 Oehring
2017/0037718 A1 2/2017 Coli et al.
2017/0104389 A1 4/2017 Morris et al.
2017/0114625 A1 4/2017 Norris
2017/0218843 A1 8/2017 Oehring et al.
2017/0222409 A1 8/2017 Oehring et al.
2017/0226842 A1 8/2017 Omont et al.
2017/0259227 A1 9/2017 Morris et al.
2017/0292513 A1 10/2017 Haddad
2017/0313499 A1 11/2017 Hughes et al.

(56) References Cited

U.S. PATENT DOCUMENTS

| | | | | |
|---|---|---|---|---|
| 2017/0314380 | A1* | 11/2017 | Oehring | F04B 19/22 |
| 2017/0328179 | A1 | 11/2017 | Dykstra | |
| 2017/0369258 | A1* | 12/2017 | DeGaray | B01F 15/0216 |

FOREIGN PATENT DOCUMENTS

| | | |
|---|---|---|
| JP | 2004264589 | 9/2004 |
| WO | 2016/144939 | 9/2016 |
| WO | 2016/160458 | 10/2016 |

OTHER PUBLICATIONS

Non-Final Office Action issued in Corresponding U.S. Appl. No. 15/145,491 dated May 15, 2017.
Non-Final Office Action issued in corresponding U.S. Appl. No. 15/291,842 dated Jan. 6, 2017.
Non-Final Office Action issued in corresponding U.S. Appl. No. 15/293,681 dated Feb. 16, 2017.
Final Office Action issued in corresponding U.S. Appl. No. 15/145,491 dated Jan. 20, 2017.
Non-Final Office Action issued in corresponding U.S. Appl. No. 15/145,443 dated Feb. 7, 2017.
Notice of Allowance issued in corresponding U.S. Appl. No. 14/622,532 dated Mar. 27, 2017.
Notice of Allowance issued in corresponding U.S. Appl. No. 15/217,040 dated Mar. 28, 2017.
Non-Final Office Action issued in corresponding U.S. Appl. No. 15/486,970 dated Jun. 22, 2017.
Non-Final Office Action issued in corresponding U.S. Appl. No. 15/487,656 dated Jun. 23, 2017.
Non-Final Office Action issued in corresponding U.S. Appl. No. 15/487,694 dated Jun. 26, 2017.
Non-Final Office Action issued in corresponding U.S. Appl. No. 14/884,363 dated Sep. 5, 2017.
Final Office Action issued in corresponding U.S. Appl. No. 15/145,491 dated Sep. 6, 2017.
Non-Final Office Action dated Oct. 6, 2017 in related U.S. Appl. No. 14/881,535.
Non-Final Office Action dated Nov. 29, 2017 in related U.S. Appl. No. 15/145,414.
Non-Final Office Action dated Nov. 13, 2017 in related U.S. Appl. No. 15/644,487.
Canadian Office Action dated Jun. 22, 2018 in related Canadian Patent Application No. 2,886,697.
Canadian Office Action dated Mar. 2, 2018 in related Canadian Patent Application No. 2,833,711.
Office Action dated Apr. 2, 2018 in related U.S. Appl. No. 15/183,387.
Office Action dated May 29, 2018 in related U.S. Appl. No. 15/235,716.
Canadian Office Action dated Apr. 18, 2018 in related Canadian Patent Application No. 2,928,711.
Office Action dated Jul. 25, 2018 in related U.S. Appl. No. 15/644,487.
Non-Final Office Action dated Oct. 4, 2018 in related U.S. Appl. No. 15/217,081.
International Search Report and Written Opinion dated Sep. 19, 2018 in related PCT Patent Application No. PCT/US2018/040683.
Canadian Office Action dated Sep. 28, 2018 in related Canadian Patent Application No. 2,945,281.
Office Action dated Dec. 12, 2018 in related U.S. Appl. No. 16/160,708.
International Search Report and Written Opinion dated Jan. 2, 2019 in related PCT Patent Application No. PCT/US18/54542.
International Search Report and Written Opinion dated Jan. 2, 2019 in related PCT Patent Application No. PCT/US18/54548.
International Search Report and Written Opinion dated Dec. 31, 2018 in related PCT Patent Application No. PCT/US18/55913.
International Search Report and Written Opinion dated Jan. 4, 2019 in related PCT Patent Application No. PCT/US18/57539.

* cited by examiner

INDEPENDENT CONTROL OF AUGER AND HOPPER ASSEMBLY IN ELECTRIC BLENDER SYSTEM

CROSS REFERENCE TO RELATED APPLICATIONS

This application claims priority to and the benefit of U.S. Provisional Application Ser. No. 62/242,657, filed Oct. 16, 2015 and is a continuation-in-part of, and claims priority to and the benefit of U.S. patent application Ser. No. 15/202,085, filed Jul. 5, 2016, which claimed priority to and the benefit of Ser. No. 13/679,689, filed Nov. 16, 2012, which issued as U.S. Pat. No. 9,410,410 on Aug. 9, 2016; the full disclosures of which are hereby incorporated by reference herein for all purposes.

BACKGROUND OF THE INVENTION

1. Field of Invention

The present disclosure relates to operations in a subterranean formation. In particular, the present disclosure relates to a hydraulic fracturing system.

2. Description of Related Art

Hydraulic fracturing is a technique used to stimulate production from some hydrocarbon producing wells. The technique usually involves injecting fluid into a wellbore at a pressure sufficient to generate fissures in the formation surrounding the wellbore. Typically, the pressurized fluid is injected into a portion of the wellbore that is pressure isolated from the remaining length of the wellbore so that fracturing is limited to a designated portion of the formation. The fracturing fluid slurry, whose primary component is usually water, includes proppant (such as sand or ceramic) that migrate into the fractures with the fracturing fluid slurry and remain to prop open the fractures after pressure is no longer applied to the wellbore. Other than water, potential primary fluids for the slurry include nitrogen, carbon dioxide, foam (nitrogen and water), diesel, or other fluids. The fracturing slurry may also contain a small component of chemical additives, which can include scale build up inhibitors, friction reducing agents, viscosifiers, stabilizers, pH buffers, acids, biocides, and other fluid treatments. In embodiments, the chemical additives comprise less than 1% of the fracturing slurry.

The fluids are blended with a proppant in the blender unit. The proppant is supplied from a nearby proppant source via a conveyor into a hopper associated with the blender unit. The hopper associated with the blender unit can be difficult to align with the proppant feed. This difficulty arises, in part, because during transport on a trailer, the hopper of the blender unit is typically placed in a raised position. In order to properly position the hopper relative to the conveyor, so that the hopper can receive proppant, three steps are necessary, including 1) the trailer carrying the blender unit must be aligned with the conveyor, 2) power must be connected to the blender unit, and 3) the hopper must be lowered into position to receive proppant from the conveyor.

The problem lies in the necessary order of these three steps in known systems. For example, typically, power to the blender unit is not connected until all trailers and equipment are in place at the well site. Because the hopper cannot be lowered into position until power is connected to the blender unit, this means that the blender unit trailer must be positioned relative to the conveyor while the hopper unit is in the elevated position. The problem with this is that when in the hopper is in the elevated position, it is very difficult to tell when the trailer is properly aligned with the conveyor. Furthermore, by the time power is connected, allowing the hopper to be lowered, it is too late to reposition the blender unit trailer if the hopper does not properly align with the conveyor.

SUMMARY OF THE INVENTION

Disclosed herein are embodiment systems and methods of hydraulic fracturing with independent control of an auger and hopper assembly. In embodiments, a hydraulic fracturing system includes a blender unit capable of mixing proppant and fluid. A first power supply, such as an electric generator, can be used to power the blender unit. The system can further include an auger and hopper assembly, which includes one or more augers, a hopper, and a hydraulic cylinder. The hopper can receive proppant through an upper opening and transport the proppant out of the hopper using one or more augers. The hydraulic cylinder, when activated by one or more actuators for example, can move the auger and hopper assembly between a stowed position and a deployed position.

A second power supply, such as a battery, can power the auger and hopper assembly. The second power supply can operate independently of the first power supply. In other words, in embodiments, the battery can supply power to the auger and hopper assembly with no power input from the electric generator. The battery, however, can be recharged by the electric generator when the electric generator is on. Thus, the first power supply can recharge the second power supply, but the second power supply operates independently when powering the auger and hopper assembly. In embodiments, the second power supply is a 12-volt direct current battery. In embodiments, one or more batteries are connected in parallel to form a power supply.

The hydraulic fracturing system can further include a blender tub positioned beneath the auger outlets. When the auger and hopper assembly is in the deployed position, the auger outlets become aligned with upper opening of the blender tub. That is, the approximate center of the blender tub can be positioned below the auger outlets when the auger and hopper assembly is in the deployed position.

Methods according to various embodiments can include positioning a blender unit near a proppant source. The blender unit can be mobile. For example, it can be positioned on a truck or trailer that includes various other components of a blender system, such as a blender tub with an upper opening, and an auger and hopper assembly with the hopper having an upper opening and the auger outlets being positioned above the center of the blender tub. An example method can further include deploying the auger and hopper assembly from a stowed position to a deployed position. When the assembly is in the deployed position, the hopper will be aligned with a proppant feed from the proppant source. For example, the proppant can be fracturing sand, and the proppant feed can be a sand conveyor configured to deliver sand to the hopper. Deploying the assembly, according to various embodiments, includes powering one or more actuators with a battery. In addition, the blender unit can be connected to a power supply, which is independent from the battery that powers the actuators of the auger and hopper assembly.

When the auger and hopper assembly is moved to the deployed position, proppant from the proppant feed can be received into the hopper through the upper opening of the hopper. One or more augers with inlets positioned to receive proppant from the hopper can move proppant out of the hopper. The auger outlets are positioned above the blender tub when the auger and hopper assembly is in the deployed position. Proppant from the hopper can then be released via the auger outlets into the blender tub, where it is received by the blending unit. The blending unit can then mix the proppant with a fluid to prepare a fracturing slurry. This slurry can be pumped to a fracturing pump system, where it can be highly pressurized and pumped into a subterranean formation, as discussed in more detail below.

BRIEF DESCRIPTION OF DRAWINGS

Some of the features and benefits of the present invention having been stated, others will become apparent as the description proceeds when taken in conjunction with the accompanying drawings, in which.

Figure 1:
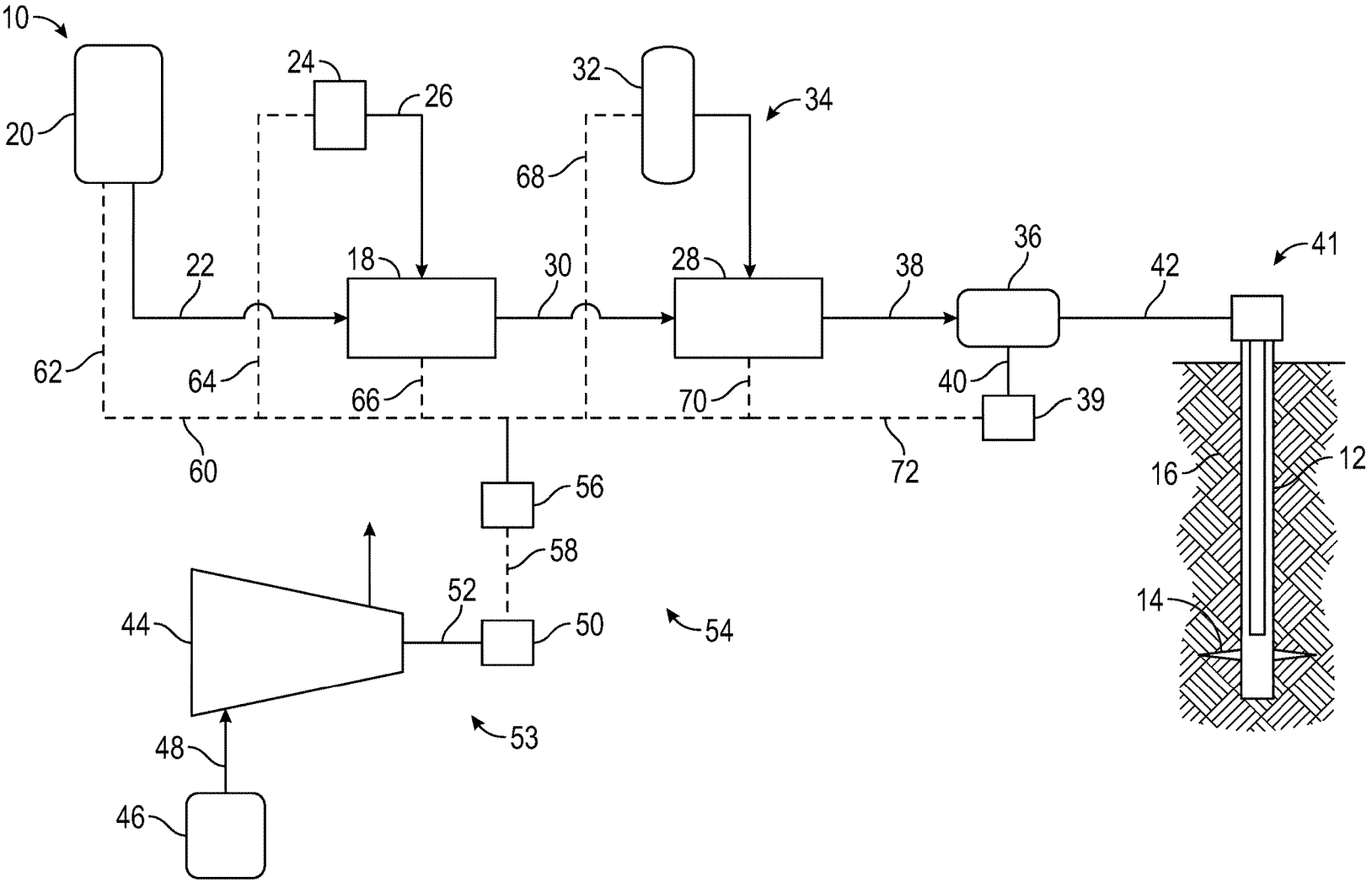
FIG. 1 is a schematic example of a hydraulic fracturing system according to certain embodiments.

While the invention will be described in connection with certain embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a schematic example of a hydraulic fracturing system 10 that is used for pressurizing a wellbore 12 to create fractures 14 in a subterranean formation 16 that surrounds the wellbore 12. Included with the system 10 is a hydration unit 18 that receives fluid from a fluid source 20 via line 22, and also selectively receives additives from an additive source 24 via line 26. Additive source 24 can be separate from the hydration unit 18 as a stand-alone unit, or can be included as part of the same unit as the hydration unit 18. The fluid, which in one example is water, is mixed inside of the hydration unit 18 with the additives. In an embodiment, the fluid and additives are mixed over a period of time to allow for uniform distribution of the additives within the fluid.

In the example of FIG. 1, the fluid and additive mixture is transferred to a blender unit 28 via line 30. A proppant source 32 contains proppant, which is delivered to the blender unit 28 as represented by line 34, where line 34 can be a conveyer. Inside the blender unit 28, the proppant and fluid/additive mixture are combined to form a fracturing slurry, which is then transferred to a fracturing pump system 36 via line 38; thus fluid in line 38 includes the discharge of blender unit 28 which is the suction (or boost) for the fracturing pump system 36. Blender unit 28 can have an onboard chemical additive system, such as with chemical pumps and augers. Optionally, additive source 24 can provide chemicals to blender unit 28; or a separate and stand-alone chemical additive system (not shown) can be provided for delivering chemicals to the blender unit 28. In an example, the pressure of the slurry in line 38 ranges from around 80 psi to around 100 psi. The pressure of the slurry can be increased up to around 15,000 psi by pump system 36.

A motor 39, which connects to pump system 36 via connection 40, drives pump system 36 so that it can pressurize the slurry. In one example, the motor 39 is controlled by a variable frequency drive ("VFD"). In one embodiment, a motor 39 may connect to a first pump system 36 via connection 40 and to a second pump system 36 via a second connection 40. After being discharged from pump system 36, slurry is pumped into a wellhead assembly 41; discharge piping 42 connects discharge of pump system 36 with wellhead assembly 41 and provides a conduit for the slurry between the pump system 36 and the wellhead assembly 41. In an alternative, hoses or other connections can be used to provide a conduit for the slurry between the pump system 36 and the wellhead assembly 41. Optionally, any type of fluid can be pressurized by the fracturing pump system 36 to form injection fracturing fluid that is then pumped into the wellbore 12 for fracturing the formation 14, and is not limited to fluids having chemicals or proppant.

An example of a turbine 44 is provided in the example of FIG. 1 and which receives a combustible fuel from a fuel source 46 via a feed line 48. In one example, the combustible fuel is natural gas, and the fuel source 46 can be a container of natural gas or a well (not shown) proximate the turbine 44. Combustion of the fuel in the turbine 44 in turn powers a generator 50 that produces electricity. Shaft 52 connects generator 50 to turbine 44. The combination of the turbine 44, generator 50, and shaft 52 define a turbine generator 53. In another example, gearing can also be used to connect the turbine 44 and generator 50.

An example of a micro-grid 54 is further illustrated in FIG. 1, and which distributes electricity generated by the turbine generator 53. Included with the micro-grid 54 is a transformer 56 for stepping down voltage of the electricity generated by the generator 50 to a voltage more compatible for use by electrical powered devices in the hydraulic fracturing system 10. In another example, the power generated by the turbine generator and the power utilized by the electrical powered devices in the hydraulic fracturing system 10 are of the same voltage, such as 4160 V so that main power transformers are not needed. In one embodiment, multiple 3500 kVA dry cast coil transformers are utilized. Electricity generated in generator 50 is conveyed to transformer 56 via line 58. In one example, transformer 56 steps the voltage down from 13.8 kV to around 600 V. Other step down voltages can include 4,160 V, 480 V, or other voltages. The output or low voltage side of the transformer 56 connects to a power bus 60. Lines 62, 64, 66, 68, 70, and 72 connect to power bus 60 and deliver electricity to electrically powered end users in the system 10. More specifically, line 62 connects fluid source 20 to bus 60, line 64 connects additive source 24 to bus 60, line 66 connects hydration unit 18 to bus 60, line 68 connects proppant source 32 to bus 60, line 70 connects blender unit 28 to bus 60. Another line can connect bus 60 to an optional variable frequency drive ("VFD") (not shown). The VFD can connect to motor 39. In one example, the VFD selectively provides electrical power to motor 39 via a dedicated or shared line, and can be used to control operation of motor 39, and thus also operation of pump 36.

In an example, additive source 24 contains ten or more chemical pumps for supplementing the existing chemical pumps on the hydration unit 18 and blender unit 28. Chemicals from the additive source 24 can be delivered via lines 26 to the hydration unit 18 and/or the blender unit 28. In certain embodiments, the elements of the system 10 are mobile and can be readily transported to a wellsite adjacent the wellbore 12, such as on trailers or other platforms equipped with wheels or tracks.

Figure 2:
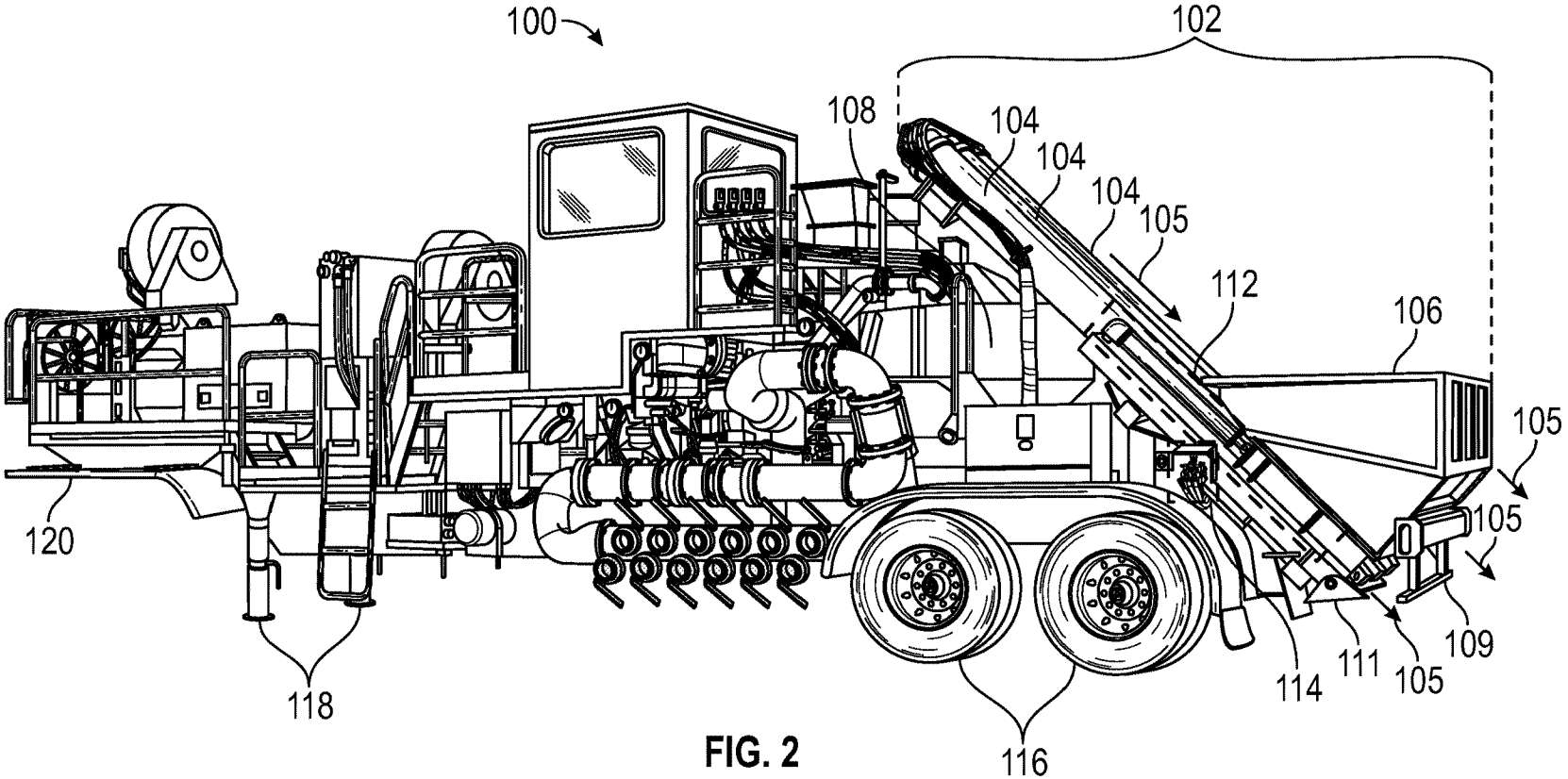
FIG. 2 is a side perspective view of a blender system with an auger and hopper assembly in a stowed position according to certain embodiments.
Figure 3:
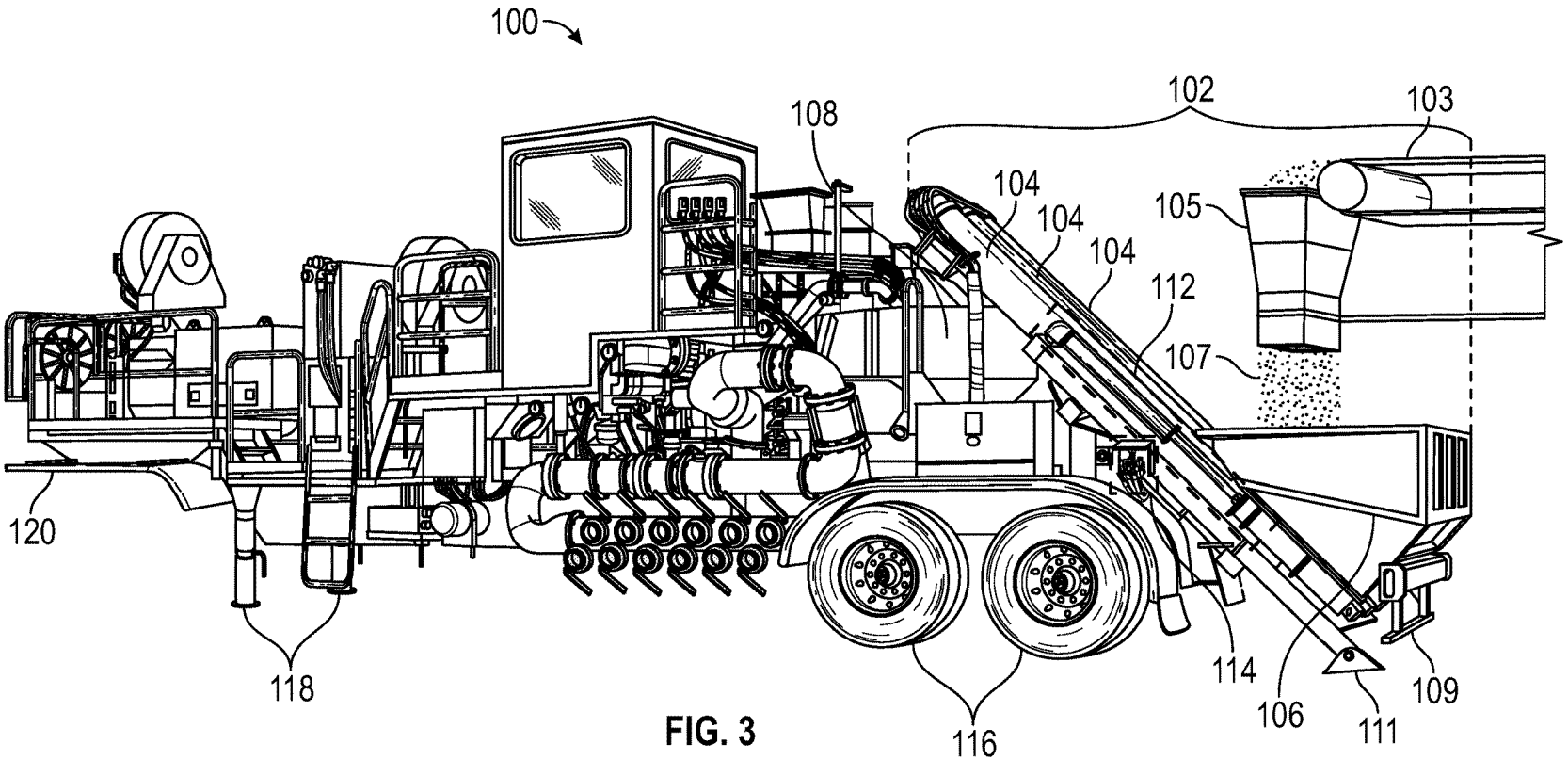
FIG. 3 is a side perspective view of a blender system with an auger and hopper assembly in a deployed position according to certain embodiments.

For example, the blender unit 28 can be positioned on a trailer, such as the exemplary trailer illustrated in FIG. 2 and FIG. 3. Thus, the blender unit 28 and various other components can comprise a blender system 100. The blender system 100 includes an auger and hopper assembly 102, which includes a hopper 106. The auger and hopper assembly 102 is capable of moving between a stowed position (FIG. 2) and a generally linearly spaced deployed position (FIG. 3). In embodiments, the stowed position is elevationally above the deployed position, and the auger and hopper assembly 102 can move in a generally linear fashion between the two positions via an angled track 112, which is positioned between the augers 104 and the blender tub 108. Looking at FIG. 2 and FIG. 3 together, the auger and hopper assembly 102 can begin in the stowed position as shown in FIG. 2. The auger and hopper assembly 102 can be directed in the direction of the arrows 105 to reach its deployed position as shown in FIG. 3. A landing gear 111 can bear the weight of the hopper 106 when the auger and hopper assembly 102 is in the deployed position. In embodiments, the landing gear 111 comprises two support legs, one on each side of the hopper 106. A bumper 109 or safety guard can also be included to keep people or equipment from making contact with the exposed auger bearings.

The auger and hopper assembly 102 is typically placed in the stowed position during transport of the blender system 100. A hitch or other suitable coupling mechanism 120 can be provided on one end of the blender system 100 to facilitate transport. The blending system 100 can be towed to a desired location at an appropriate distance from a fracking site. In the illustrated embodiment, the blending system includes unpowered wheels 116 to facilitate towing and weight-bearing legs 118 to support the blending system 100 when the towing vehicle disengages. The legs 118 can be independently adjusted to allow an operator to level the blending system, or otherwise achieve a desired tilt, even while accounting for uneven ground. Although not required for operations, the blending system 100 can be isolated, i.e. no longer connected to a towing vehicle, due to space constraints in the field. Once in position, the blending system 100 is connected to micro-grid 54 or otherwise supplied with main electrical power. The main electrical unit powers the blender unit 28, enabling it to draw fluid onboard through a suction manifold and pump, and blend the proppant and fluid/additive mixture to form a fracturing slurry, which is then boosted to a fracturing pump system 36 through a discharge pump, as described more thoroughly with respect to FIG. 1.

In other words, main power is not provided to the blender system 100 until after the blender system 100 is initially staged. In some cases, it may take days from the time the equipment is staged before power is produced and directed to the blender system 100. Moreover, the blender system 100 is typically staged early in the process—before fracking pumps, iron, and sand equipment are positioned—so delays to staging the blender system 100 hold up other portions of the process. Further still, it is very difficult and dangerous to move equipment after power cables have been connected.

Main power is typically generated by diesel engines for diesel equipment or by an electric generator for electrically powered equipment. For electrically powered equipment, an electric generator may not arrive onsite until after the blender system 100 is in place, or the electric generator may be onsite, but not generating power until after the blender system 100 is in place. Thus, if positioning the auger and hopper assembly 102 of the blender system 100 rely exclusively on the main power, the auger and hopper assembly 102 cannot be raised or lowered into an ideal placement until the main electrical power is active and connected. In the event of a misalignment, the entire blender system 100 would need to be repositioned, which would be costly, time consuming, difficult, and sometimes dangerous.

Put another way, without an independent power supply for the auger and hopper assembly 102, the blender system 100 can be maneuvered into an incorrect position, but it will not be known that the hopper 106 is improperly aligned with the proppant feed until the entire blender system 100 is connected to a power supply, such as, for example, the micro-grid 54 discussed above. Once the misalignment is detected, the entire blender system 100 would have to be disconnected from the power supply in order to reposition the blender system 100. This process may even have to be iterated multiple times given the difficulty of estimating whether the hopper 106 will be properly aligned with the conveyor belt (or appropriate proppant feed) when in the deployed position. These iterations may involve disconnecting the main power and moving other equipment to allow for maneuvering the blender system 100. This can cause hours or days of downtime. Thus prior to being transported to a wellsite, the auger and hopper assembly 102 are put into a stowed position, and remain in that position, until the main power is online. The main power stays online until the fracturing job is completed. Usually the deployed position of the auger and hopper assembly 102 is difficult to predict accurately because the equipment is initially positioned with the auger and hopper assembly 102 in the stowed position.

After the fracturing job is completed, a rig down process occurs in which equipment is removed from the site. The main power is disconnected before the blender system 100 is moved. If the auger and hopper assembly 102 is in the deployed position, the blender system 100 cannot be moved. That is, if operators disconnected the main power from the blender system 100 without stowing the auger and hopper assembly 102, and there was no independent power supply to the auger and hopper assembly 102, then the blender system 100 would be unmovable until main power was reconnected to the blender system for the sole purpose of stowing the auger and hopper assembly 102. This problem, among others, is addressed by the claimed embodiments, which allow for the auger and hopper assembly 102 to move between the stowed position and deployed position without the blender system 100 needing to be connected to the main power source.

Still referring to FIG. 2 and FIG. 3, the blender system 100 is mounted on a trailer. In this example, the blender is a fracturing blender having a capability of supplying 130 bbl/min, and it is designed to mix slurries for fracturing treatments. The slurries, which can be used in hydraulic fracturing, can also include water or other fluids. In various embodiments, the blender system 100 can be skid, truck, or trailer mounted, and can be used on or off-shore. The auger and hopper assembly 102 includes one or more obliquely angled augers 104 that lift proppant from an attached hopper 106, and deliver the proppant to a blender tub 108 as shown. The system is capable of handling a wide array of tasks associated with complex fracturing operations in harsh oil-field conditions; and is operable in temperature ranges of −4° F. (−20° C.) to 115° F. (46° C.). Embodiments of the unit include 10 inch diameter pipe and a total power rating of 1,400 BHP (minimum). In one example, the system pumps inhibited acid.

The blender system 100 includes an independently powered auger and hopper positioning system to raise and lower the auger and hopper assembly 102 prior to setting up the main electrical power. The positioning system controls 114 are used to adjust the position of the auger and hopper assembly 102. In embodiments, the power supply comprises a dedicated electric 12 VDC power supply. In one example, the positioning system includes one or more actuators for positioning the auger and hopper assembly 102. In embodiments, the actuators are powered by a 12 VDC power supply. The power supply provides power for a hydraulic pump. In embodiments, the hopper power supply is not in communication with the main electrical power. In embodiments, the battery powering the auger and hopper control system is charged by the main power supply when the main power is on. In an embodiment, the actuators include one or more electrical motors and associated linkages, where the motors provide hydraulic power to drive the hydraulic cylinders 5 (FIG. 4 and FIG. 5) and linkages with sufficient force for positioning the auger/hopper into a designated position and/or orientation. In FIG. 5, the cylinder 5 is in a retracted configuration, whereas in FIG. 4 the cylinder 5 is in an extended configuration. Alternatively, the actuators are hydraulically powered with hydraulic fluid pressurized by pumps that are powered by the 12 VDC power source.

As indicated above, when setting up a hydraulic fracturing site it is important to position the sand delivery system and the blender so that the sand 107 enters the blender hopper 106 in roughly the center of the hopper. However, it can be difficult to visualize exactly where the auger and hopper assembly 102 will be in the deployed position. Compounding this problem is that, in various embodiments, there are two blenders. One serves as a primary blender, and the other serves as a back-up blender. The proppant feed—the chute 105 on a sand conveyor belt 103, for example—needs to be able to reach both blenders, while leaving some room between the blenders for personnel and equipment, such as fluid hoses, chemical hoses, and other tools.

Embodiments of the method and system described herein position the blender system 100, lower the auger/hopper assembly 102, and align the hopper 106 with the sand conveyer and other sand equipment. The steps of aligning and positioning described herein are performed without power from the main power supply. In embodiments, the hydraulic lines for powering the auger/blender actuator are isolated from other hydraulic lines that deliver hydraulic fluid to different services or circuits, such as cooling fans, blower motors, chemical pumps, the blender's suction pump, valve actuators, and the auger motors for rotating the auger blade. Optionally, the hydraulic lines that power the auger/hopper actuator can share a same hydraulic tank as other hydraulic systems.

Figure 4:
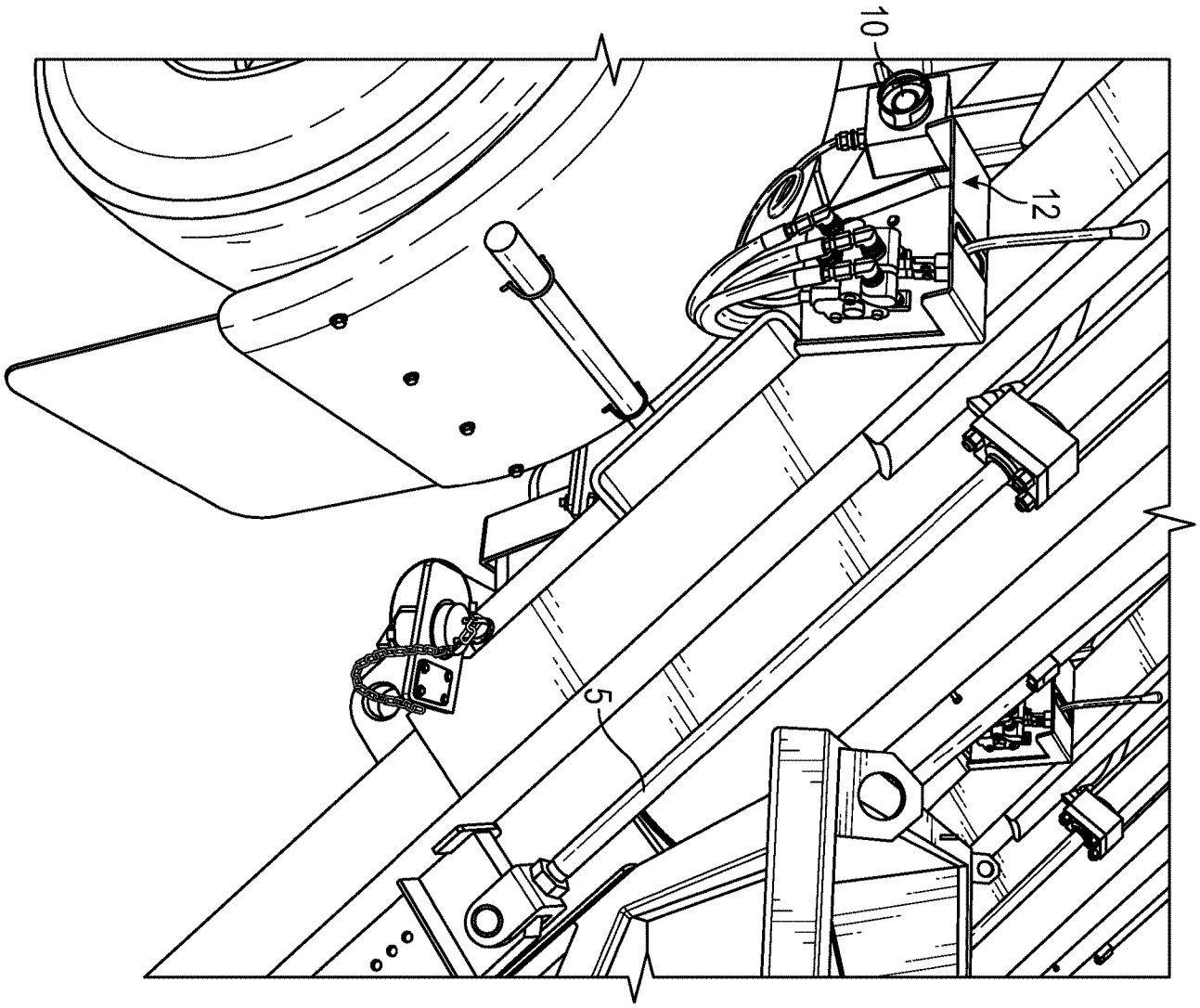
FIG. 4 is a view of a portion of a blender system with an auger and hopper assembly in a deployed position according to certain embodiments.
Figure 5:
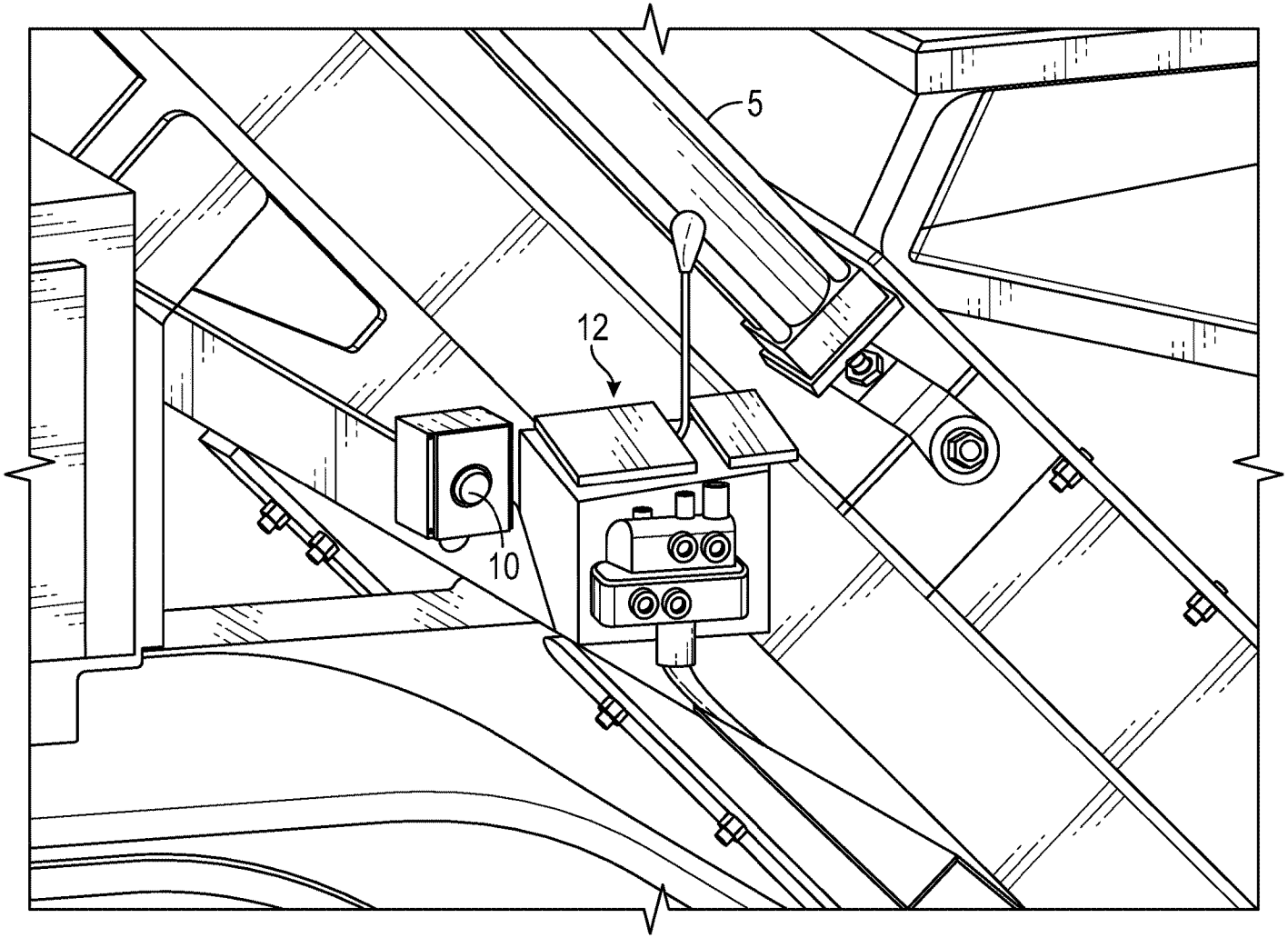
FIG. 5 is a view of a portion of a blender system with an auger and hopper assembly in a stowed position according to certain embodiments.
Figure 6:
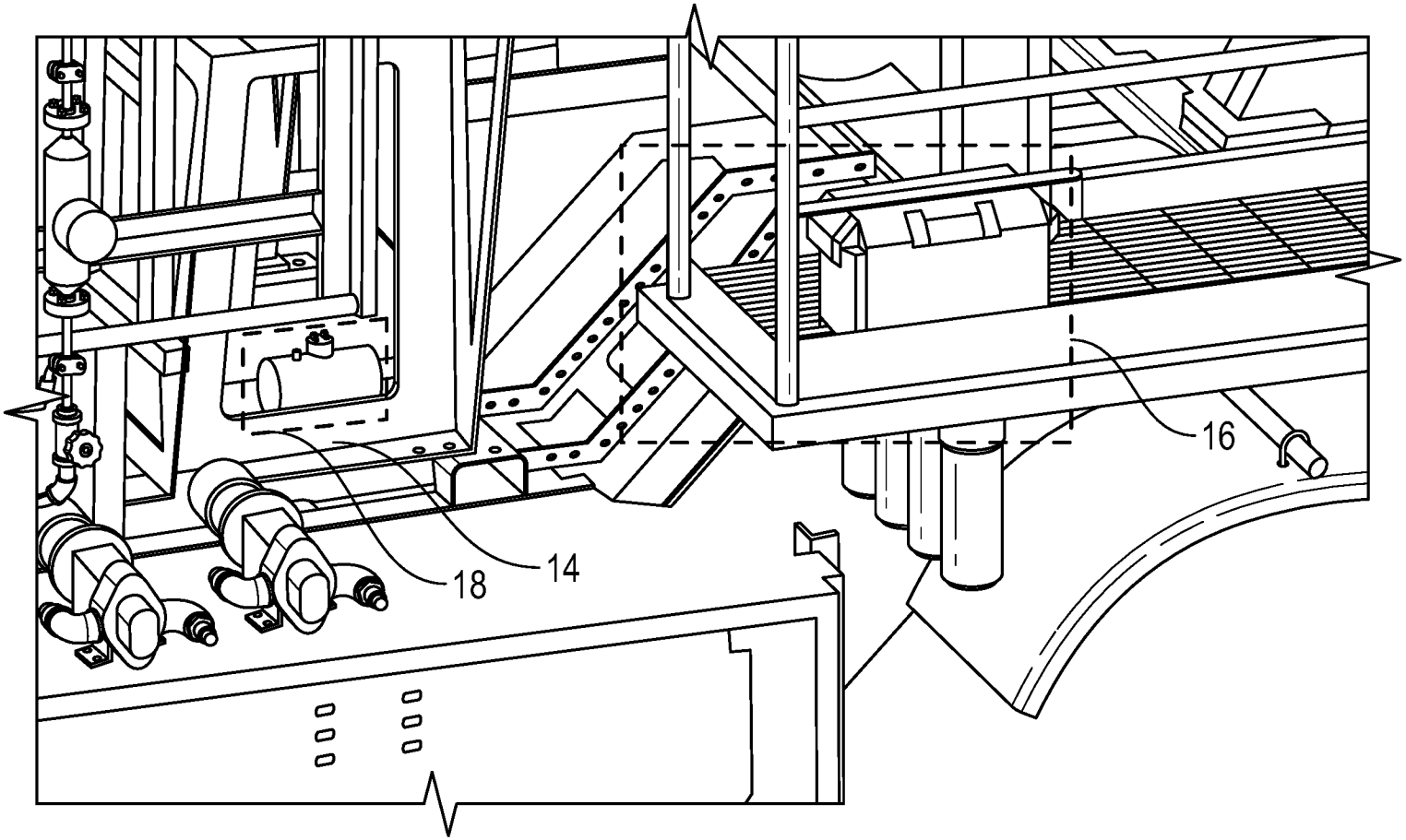
FIG. 6 is a view of a portion of a blender system according to certain embodiments.
Figure 7:
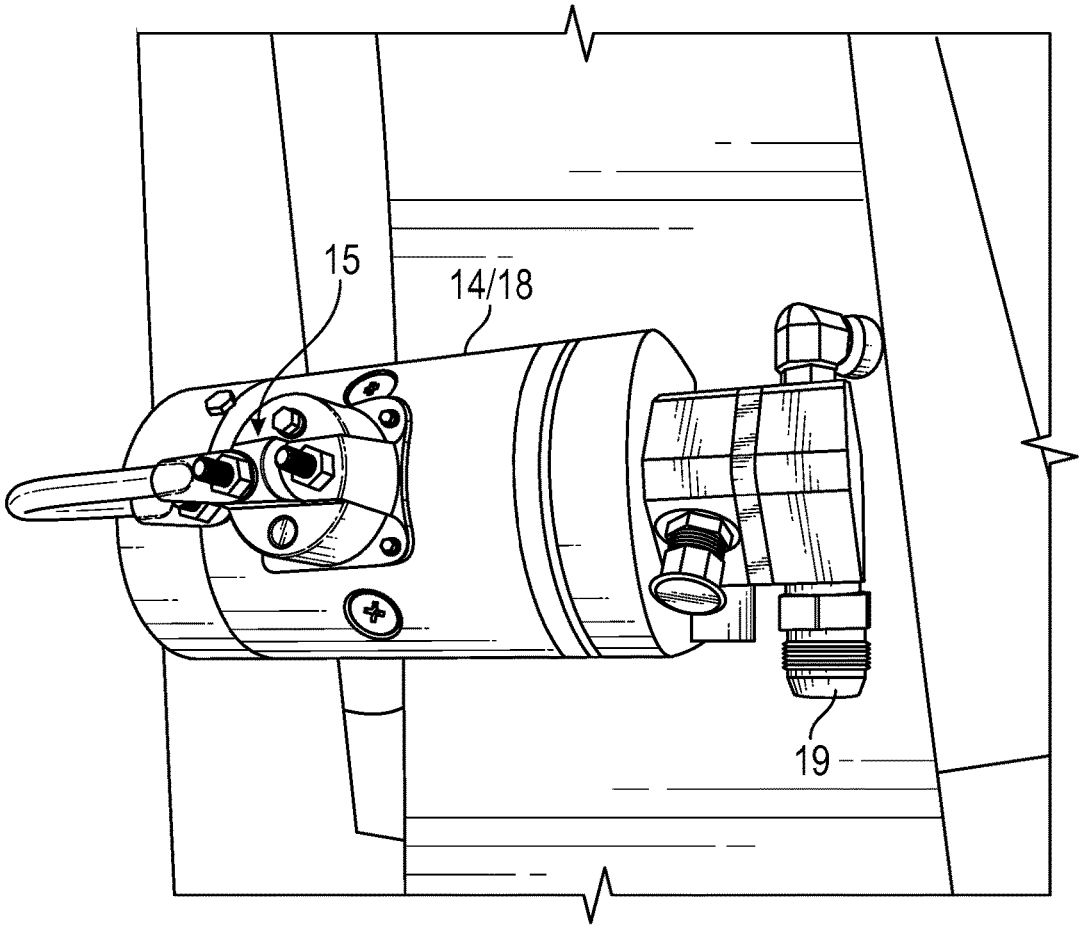
FIG. 7 is a view of a pump and motor assembly according to certain embodiments.

Referring now to FIG. 4, shown in a side perspective view is a portion of the auger and hopper assembly 102. A start button 10 can selectively energize a motor that drives a hydraulic pump, where the pump pressurizes hydraulic fluid for powering the actuators. Then the auger and hopper assembly 102 can be raised or lowered using a three-position valve 12. The three-position valve 12 can include positions for stowed, deployed, and closed. In certain embodiments, the stowed position can be labeled "up," and the deployed position can be labeled "down" on the valve 12. In the example of FIG. 4, the valve 12 is disposed in a hydraulic circuit and between the hydraulic pump and the actuators. Shown in perspective view in FIG. 6 is an example of a hydraulic pump 14 for pressurizing the hydraulic fluid used to actuate cylinder 5 (FIG. 5) into an extended position for selectively positioning the auger and hopper assembly 102. Further illustrated in FIG. 6 is a battery 16 that selectively provides electrical power to a motor 18 shown schematically coupled with the pump 14. The motor 18 and pump 14 are provided in a single unit in certain embodiments. FIG. 7 provides another view of this unit. Electrical connections 15 are provided to connect the motor 18 to the battery 16 (shown in FIG. 6; not shown in FIG. 7). Hydraulic connections 19 to the pump 14 are provided as well.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

That claimed is:

1. A system comprising:

a blender unit configured to mix proppant and fluid;

a first power supply to power the blender unit during hydraulic fracturing operations;

an assembly that moves in a generally linear fashion between a stowed position and a generally linearly spaced deployed position, the assembly including:

a hopper that receives proppant through an upper opening, and at least one auger with an inlet positioned below an outlet of the hopper to receive proppant from the hopper as the proppant exits the hopper; and a second power supply to power the assembly in moving between the stowed position and the deployed position, the second power supply operating independently of the first power supply when the second power supply is powering the assembly.

2. The system of claim 1, further comprising one or more actuators, wherein powering the assembly includes supplying power from the second power supply to the one or more actuators.

3. The system of claim 1, wherein the first power supply comprises an electric generator, the second power supply comprises at least one battery, and the electric generator recharges the at least one battery.

4. The system of claim 3, wherein the at least one battery comprises at least one 12 volt direct current battery.

5. The system of claim 1, further comprising a blender tub, wherein the at least one auger includes an auger outlet positioned above the blender tub when the assembly is positioned in the deployed position, and the at least one auger selectively releases proppant into the blender tub via the auger outlet.

6. The system of claim 1, wherein the hopper receiving proppant through the upper opening includes the hopper receiving sand from a sand conveyor through the upper opening, and wherein the deployed position of the assembly aligns the hopper with a chute that feeds sand from the sand conveyor.

7. The system of claim 1, wherein the first power supply comprises an electric generator powered by combustion of a fuel in a turbine.

* * * * *